US007066773B1

(12) United States Patent
Martin

(10) Patent No.: US 7,066,773 B1
(45) Date of Patent: Jun. 27, 2006

(54) ELECTRICAL CONNECTOR WITH TPA STOP

(75) Inventor: Galen M. Martin, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/052,416

(22) Filed: Feb. 7, 2005

(51) Int. Cl.
*H01R 13/514* (2006.01)

(52) U.S. Cl. ..... 439/752

(58) Field of Classification Search ..... 439/752, 439/595, 364, 362
See application file for complete search history.

(56) References Cited

U.S. PATENT DOCUMENTS 5,181,862 A * 1/1993 Hawk et al. ..... 439/595
6,053,753 A * 4/2000 Kunkle ..... 439/275
6,375,503 B1 * 4/2002 Ohsumi ..... 439/595
6,592,410 B1 * 7/2003 Yoshida et al. ..... 439/701
6,599,150 B1 * 7/2003 Martin et al. ..... 439/595
6,682,366 B1 * 1/2004 Tanaka ..... 439/595
6,935,893 B1 * 8/2005 Flowers et al. ..... 439/595
2005/0186842 A1 * 8/2005 Fukatsu et al. ..... 439/595

* cited by examiner

*Primary Examiner*—Tulsidas C. Patel
*Assistant Examiner*—Nguyen Phuongchi

(57) ABSTRACT

An electrical connector includes a housing that receives an electrical contact. The housing includes a stop element. A terminal position assurance (TPA) member is loaded on the housing. The TPA member is moveable between a staged position and a final position. The stop element engages the TPA member in the staged position to prevent advancement of the TPA member from the staged position to the final position until a contact is fully loaded in the housing.

20 Claims, 8 Drawing Sheets

ELECTRICAL CONNECTOR WITH TPA STOP

BACKGROUND OF THE INVENTION

The invention relates generally to electrical connectors and more particularly to a connector having a terminal position assurance (TPA) element that does not move to a final position until a contact is fully loaded in the connector.

A wide variety of connectors exist for various applications. Certain connectors include terminal position assurance (TPA) elements. Typically, the TPA blocks the movement of a contact retention member in the connector that retains terminal contacts within respective contact cavities in the connector. The TPA secures the terminal contact in proper position for electrically mating with the terminal contacts of a mating connector or other electrical component. In addition, the TPA is often designed to hinder or block unintended withdrawal of the terminal contacts. In many connector designs, the TPA itself is entirely removable from the connector, which may, over time, compromise the integrity of the connector.

In the automotive industry, there are applications such as seat adjuster systems and the like, in which the TPA locks onto the connector to provide for more secure retention of the terminal contact within the connector. When the TPA locks on to the connector, the terminal contacts are less likely to vibrate out or be inadvertently removed, such as during the servicing of a nearby component or system. At least some connectors are shipped in a staged position in which the TPA is partially inserted in the connector and later moved to a final position after contacts are fully seated in the connector. Typically, however, the TPA can also be moved to the final position even if a contact is not inserted at all.

Thus, while shipment in a staged position can prevent the loss of components, there is also the problem, particularly when shipped in bulk or subjected to rough handling, of the TPA being moved prematurely to the final position. An operator then has to pull the TPA back out with the risk of breaking or damaging the connector or the TPA or both.

BRIEF DESCRIPTION OF THE INVENTION

In one aspect, an electrical connector is provided. The connector includes a housing that receives an electrical contact. The housing includes a stop element. A terminal position assurance (TPA) member is loaded on the housing. The TPA member is moveable between a staged position and a final position. The stop element engages the TPA member in the staged position to prevent advancement of the TPA member from the staged position to the final position until a contact is fully loaded in the housing.

Optionally, the TPA member includes a platform having a latch that engages an interior surface of the housing to inhibit extraction of the TPA member from the housing when the TPA member is in the staged position. The housing includes a power contact cavity and a signal contact cavity, and the stop element is positioned within the power contact cavity. The TPA member includes a deflectable beam, and the stop element engages the deflectable beam to inhibit the TPA member from moving from the staged position to the final position when the contact is not fully loaded in the housing.

In another aspect, an electrical connector is provided that includes a housing configured to receive a contact. The housing has a contact retention element. A terminal position assurance (TPA) member is loaded on the housing and is moveable between a staged position and a final position. The contact engages the TPA member when the contact is fully loaded in the housing to enable the TPA member to move from the staged position to the final position wherein the contact is retained in the housing.

In yet another aspect, an electrical connector is provided that includes a housing configured to receive an electrical contact. The housing has a stop element. A terminal position assurance (TPA) member loaded on the housing. The TPA member is moveable between a staged position and a final position. The stop element engages the TPA member in the staged position to prevent advancement of the TPA member to the final position until a contact is fully loaded in the housing. The contact engages the TPA member when the contact is fully loaded in the housing to enable the TPA member to move from the staged position to the final position wherein the contact is retained in the housing.

DETAILED DESCRIPTION OF THE INVENTION

Figure 1:
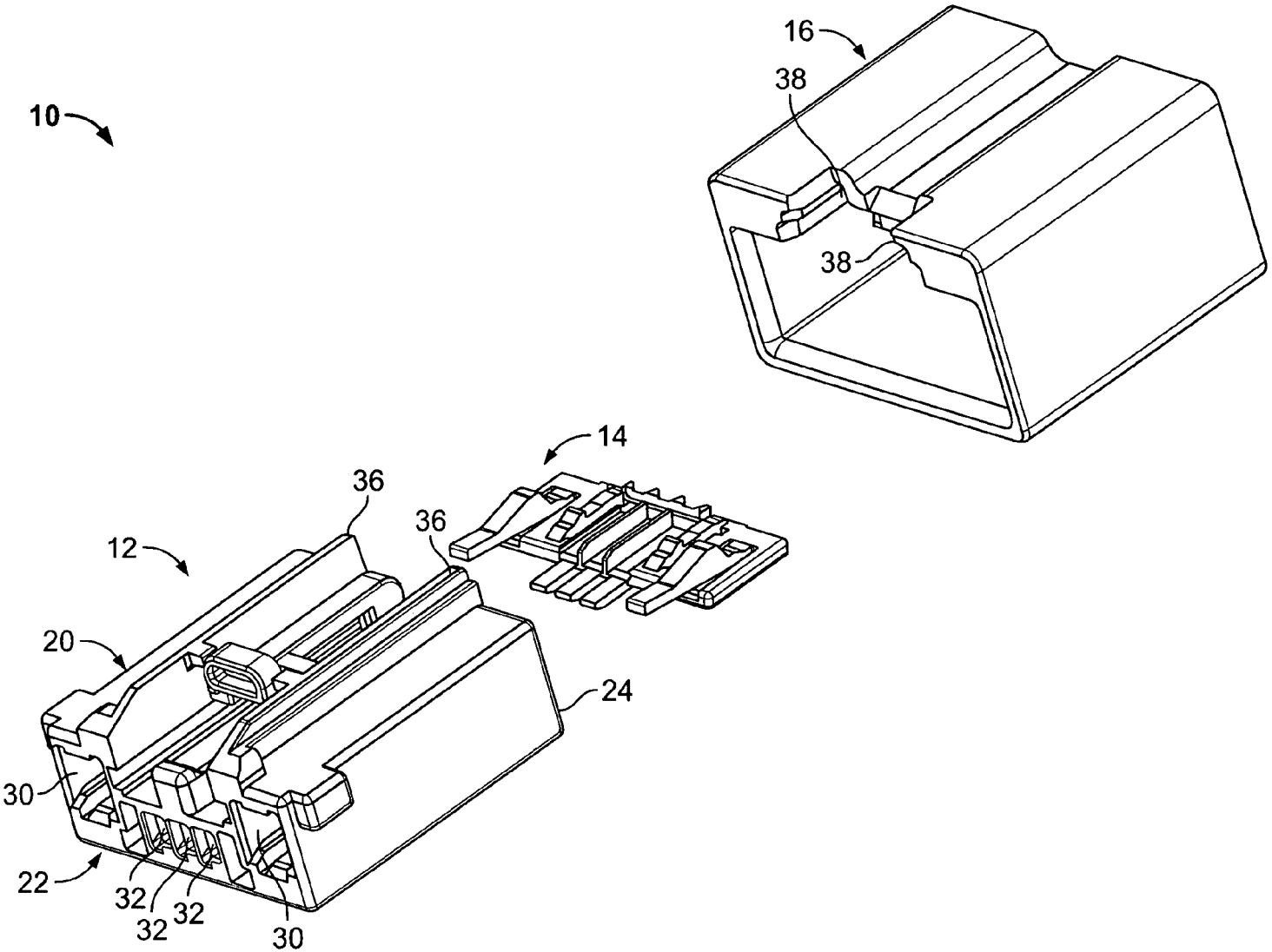
FIG. 1 is an exploded view of an electrical connector assembly formed in accordance with an exemplary embodiment of the present invention.

FIG. 1 is an exploded view of an electrical connector assembly 10 formed in accordance with an exemplary embodiment of the present invention. The connector assembly 10 includes a connector 12, a terminal position assurance (TPA) member 14 that is received in the connector 12, and a mating connector 16. In one embodiment of the invention, the connector 12 provides power and signal connections to the mating connector 16.

The connector 12 includes a housing 20 that has a terminal receiving end 22 and a mating end 24. Electrical contacts (not shown in FIG. 1), are loaded into the housing 20 through contact cavities 30 and 32. In one embodiment, the contact cavities 30 are power contact cavities while the contact cavities 32 are signal contact cavities. In other embodiments, a different mix of contacts or only one style of contact may be used. The TPA member 14 is received in the mating end 24 of the connector 12 and is movable to a final position that provides assurance that the electrical contacts are fully seated in the housing 20 before the connector 12 is mated with the mating connector 16. More specifically, the TPA member 14 provides assurance that power contacts (not shown) are present and also fully seated in the housing 20 and that signal contacts (not shown), if present, are also fully seated in the housing 20. Keying ribs 36 formed on the housing 20 are received in complementary keying channels 38 in the mating connector 16 to position and align the connector 12 for mating with the mating connector 16.

Figure 2:
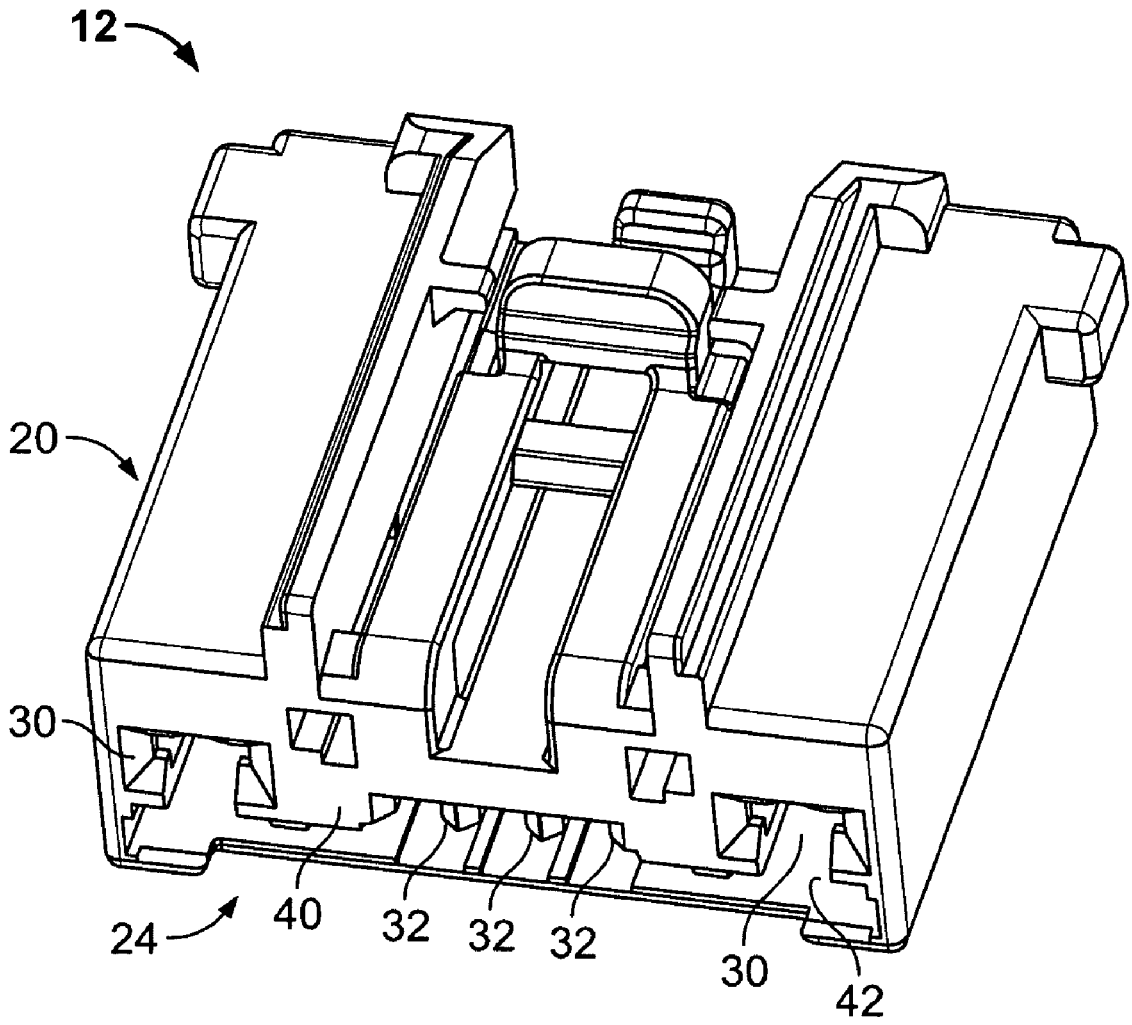
FIG. 2 is a perspective view from the mating end of the connector shown in FIG. 1.

FIG. 2 is a perspective view of the connector 12 from the mating end 24 of the housing 20. The mating end 24 includes mating ends of the power contact cavities 30 and the signal contact cavities 32 that open to a mating end wall 40. A TPA channel 42 extends transversely across the mating end 24 of the housing 20. In the illustrated embodiment, the housing 20 includes two power contact cavities 30 and three signal contact cavities 32. In other embodiments, greater or fewer power contact cavities, signal contact cavities, and associated contacts may be utilized.

Figure 3:
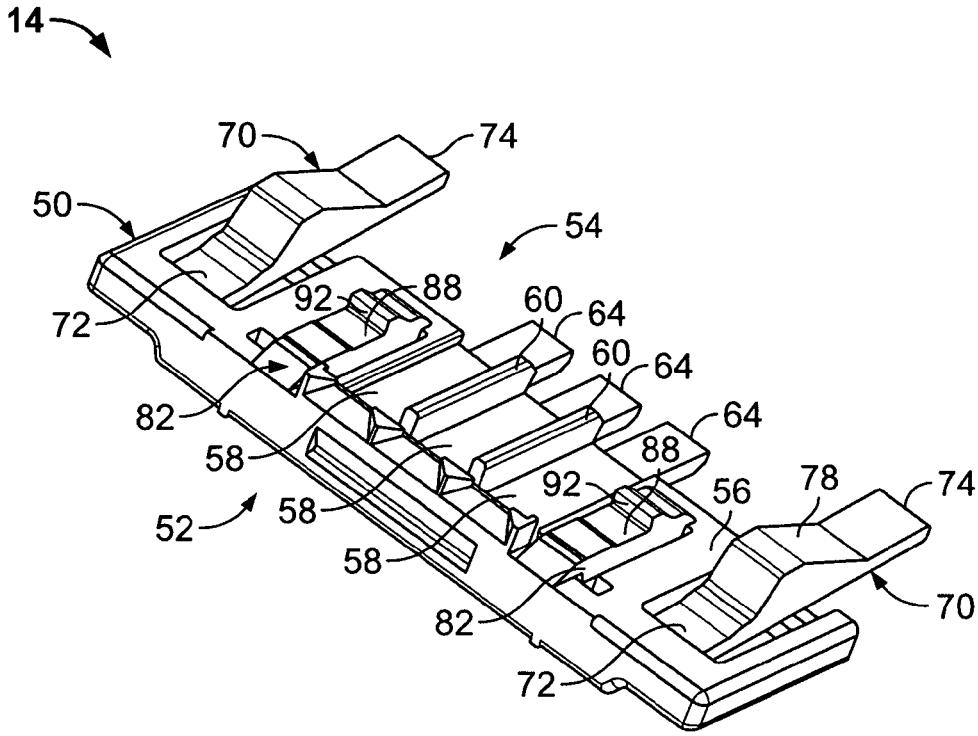
FIGS. 3 and 4 are perspective views of the TPA shown in FIG. 1.
Figure 4:
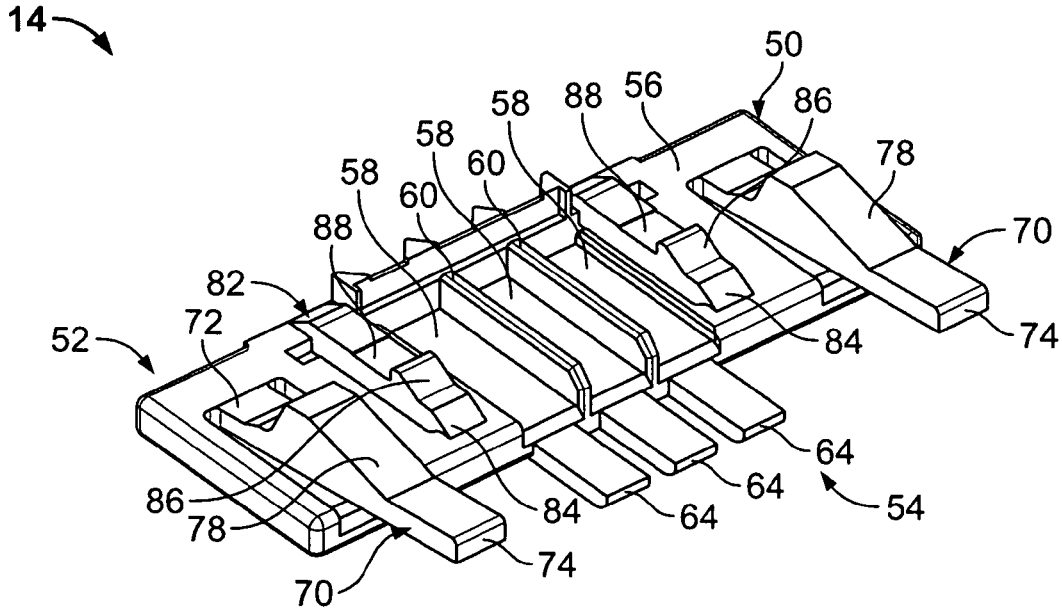

FIGS. 3 and 4 are perspective views of the TPA member 14. The TPA member 14 includes a base 50 that is substantially rectangular in shape and has a forward end 52, and an insertion end 54 that is received in the housing 20. The base 50 has an upper surface 56 that includes contact channel faces 58 and dividing ribs 60 formed thereon that form a lower portion of the mating end of the signal contact cavities 32 when the TPA member 14 is inserted in the housing 20 (FIG. 2). Fixed TPA wedges 64 are positioned at each signal contact position to provide assurance that the signal contacts (not shown) are fully seated in the housing 20 as will be described.

The TPA member 14 includes a deflectable beam 70 at each power contact position. The deflectable beam 70 has an attachment end 72 that is pivotably attached to the base 50 and an engagement end 74 opposite the attachment end 72. A ramped portion 78 is formed between the attachment end 72 and the engagement end 74. The TPA member 14 also includes platforms 82 that each include first and second inclined surfaces 84 and 86 respectively proximate the insertion end 54 of the TPA member 14. A recess 88 and a latch 92 are formed forward of the second incline 86. The latch 92 engages an interior surface (not shown) of a portion of the mating end wall 40 (FIG. 2) of the housing 20 (FIG. 2) to inhibit extraction of the TPA member from the housing 20 when the TPA member is in a staged position.

Figure 5:
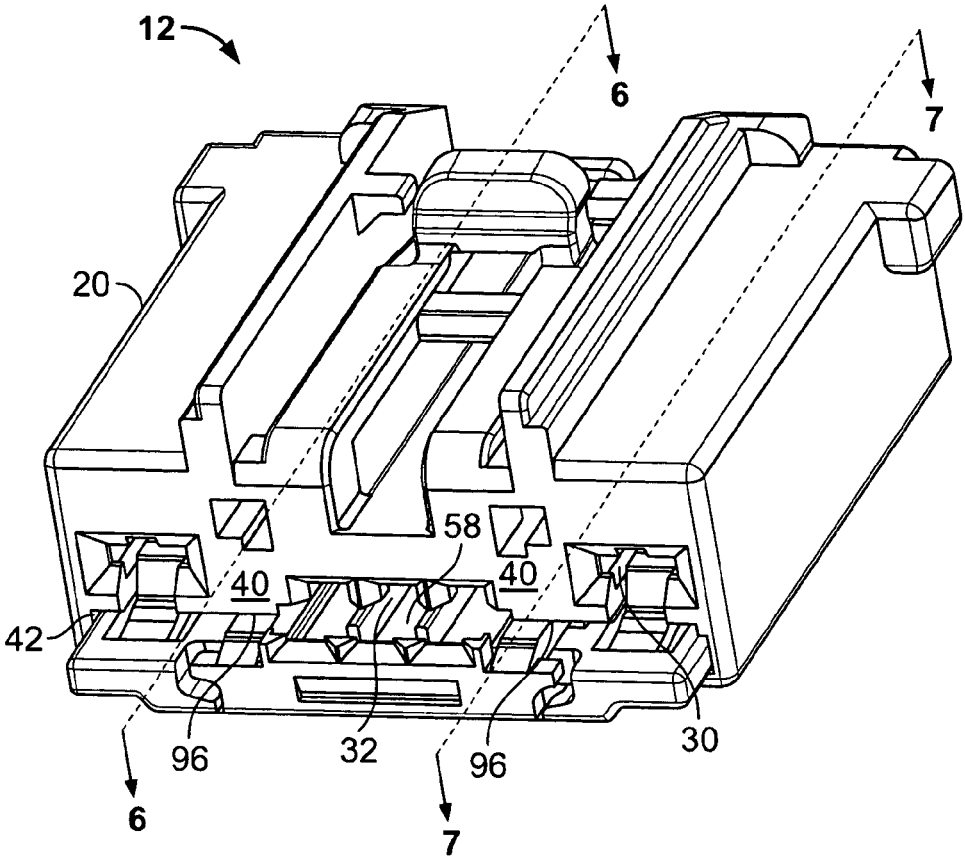
FIG. 5 is a perspective view of the connector and TPA shown in FIG. 1 with the TPA in the staged position.

FIG. 5 illustrates a perspective view of the connector 12 with the TPA member 14 inserted into the connector 12 in a staged position. In the staged position, the TPA member 14 is retained in the housing 20 in a position that allows the electrical contacts to be installed or loaded into the housing 20. The TPA member 14 is held in the staged position by engagement of the platform 82 (FIG. 2) with the housing 20. As the TPA member 14 is inserted into the TPA channel 42 the first and second inclines 84 and 86 (FIG. 4), respectively, engage and slide under lower edges 96 of the mating end wall 40. When the second inclines 86 are inserted past the interior surface (not shown) of the mating end wall 40 of the housing 20, the lower edges 96 snap into the recesses 88 on the platform 82 and the latches 92 engage the inside surface of the mating end wall 40 to inhibit removal of the TPA member 14.

Figure 6:
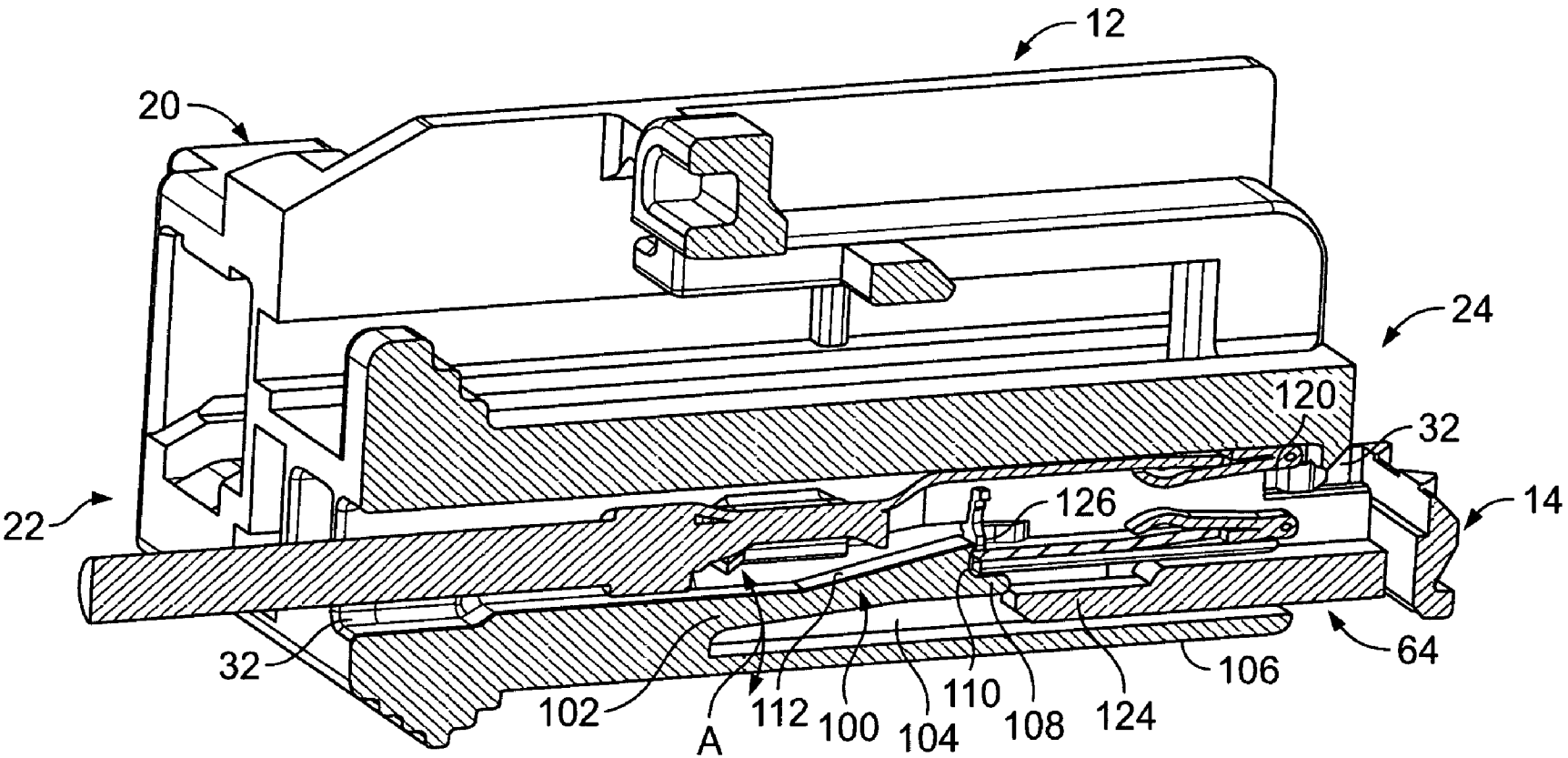
FIG. 6 is a cross sectional view of the connector and staged TPA taken along the line 6—6 in FIG. 5.

FIG. 6 is a cross sectional view of the connector 12 and TPA member 14 taken through the section line 6—6 in FIG. 5 which extends through the centrally positioned signal contact cavity 32. FIG. 6 illustrates the operation of the fixed wedges 64 of the TPA member in the signal contact cavities 32. The housing 20 includes a first contact retention member 100 that is pivotably connected to the housing 20 at a first end 102 and is configured to pivot upward and downward within the contact cavity 32 as indicated by the double arrow A. A gap 104 between the first contact retention member 100 and a housing bottom wall 106 provides clearance for downward pivotal movement of the first contact retention member 100. In an exemplary embodiment, the first contact retention member 100 is integrally formed with the housing 20. The first contact retention member 100 extends from the first end 102 to a second end 108 toward the connector mating end 24. A contact latch 110 is formed at the second end 108 of the first contact retention member 100 and a ramped section 112 is formed between the first and second ends 102 and 108, respectively.

The first contact retention member 100 is formed such that the second end 108 is biased in an upward position and extends into the contact cavity 32 so that the first contact retention member 100 interferes with a signal contact 120 when the signal contact 120 is loaded into the contact cavity 32. The signal contact 120 is inserted into the contact cavity 32 from the terminal receiving end 22 of the housing 20. When the signal contact 120 is inserted into the contact cavity 32, the signal contact 120 engages the ramped section 112 of the first contact retention member 100 and causes the first contact retention member 100 to pivot downward moving the second end 108 into the gap 104 which indicates that the signal contact 120 is only partially seated. When the second end 108 of the first contact retention member 100 is deflected into the gap 104, the second end 108 is positioned to interfere with the fixed TPA wedge 64 to prevent entry of an end 124 of the wedge 64 into the gap 104 such that the TPA member 14 cannot be fully inserted into the housing 20 to place the TPA member 14 in a final position.

As the signal contact 120 is advanced further into the contact cavity 32, the signal contact 120 passes the ramped section 112 and the second end 108 moves upward, returning to its biased position. The signal contact 120 is then fully seated. When the signal contact 120 is fully seated, the contact latch 110 engages an edge 126 of the signal contact 120 to retain the signal contact 120 in the contact cavity 32. Further, the end 124 of the fixed TPA wedge 64 can now be advanced into the gap 104 as the TPA member 14 is moved to a final position. When the end 124 of the fixed TPA wedge 64 is received in the gap 104, the first contact retention member 100 is blocked from pivoting into the gap 104 and thus, extraction of the signal contact 120 from the housing 20 is prevented.

Figure 7:
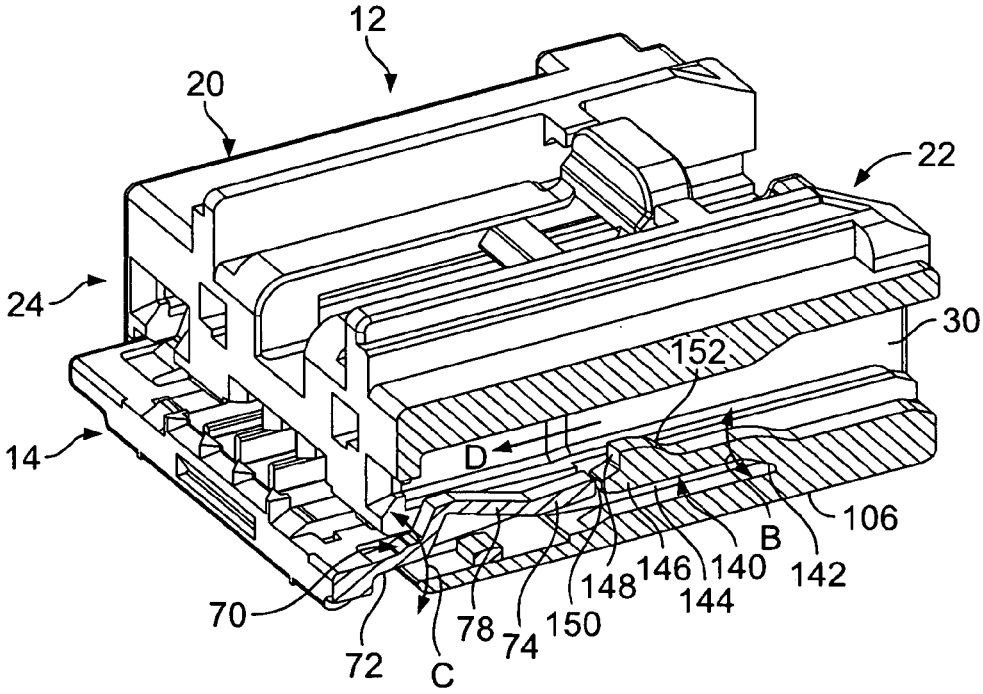
FIG. 7 is a cross sectional view of the connector and staged TPA taken along the line 7—7 in FIG. 5.

FIG. 7 is a cross sectional view of the connector 12 and TPA member 14 taken through the section line 7—7 in FIG. 5 which extends through the power contact cavity 30. The TPA member 14 is in the staged position and no power contact is present. At the power contact cavity 30, the housing 20 includes a second contact retention member 140 that is pivotably connected to the housing 20 at a first end 142 and is configured to pivot upward and downward within the contact cavity 30 as indicated by the double arrow B. A gap 144 between the second contact retention member 140 and the housing bottom wall 106 provides clearance for downward pivotal movement of the second contact retention member 140. In an exemplary embodiment, the second contact retention member 140 is also integrally formed with the housing 20. The second contact retention member 140 extends from the first end 142 to a second end 146 toward the connector mating end 24. A second contact latch 148 and a TPA stop element 150 are formed at the second end 146 of the second contact retention member 140 and a ramped section 152 is formed between the first and second ends 142 and 146, respectively. The second contact retention member 140 is formed such that the second end 146 is biased in an upward position and extends into the contact cavity 30 so that the second contact retention member 140 interferes with a power contact (not shown) when the power contact is loaded into the contact cavity 30.

The deflectable beam 70 pivots upward and downward about the attachment end 72 as indicated by the double arrow C and has an upward bias so that the engagement end 74 abuts the TPA stop element 150 on the second contact retention element 140 and the ramped portion 78 extends into a contact loading path D in the contact cavity 30 when no power contact (not shown) is present. In an exemplary embodiment, the connector 12 is not intended to be used without a complete power circuit. Thus, the TPA member 14 cannot be moved to a final position when power contacts are not loaded in the connector 12. More specifically, each of the power contact cavities 30 includes a TPA stop element 150 on a contact retention element, such as the second contact retention element 140, so that the TPA member 14 cannot be moved to the final position until power contacts are fully loaded in all of the power contact cavities 30. Further, the TPA stop element 150 provides a positive stop that prevents the TPA member from inadvertently being moved to the final position such as during shipment or as a result of rough handling or mishandling.

Figure 8:
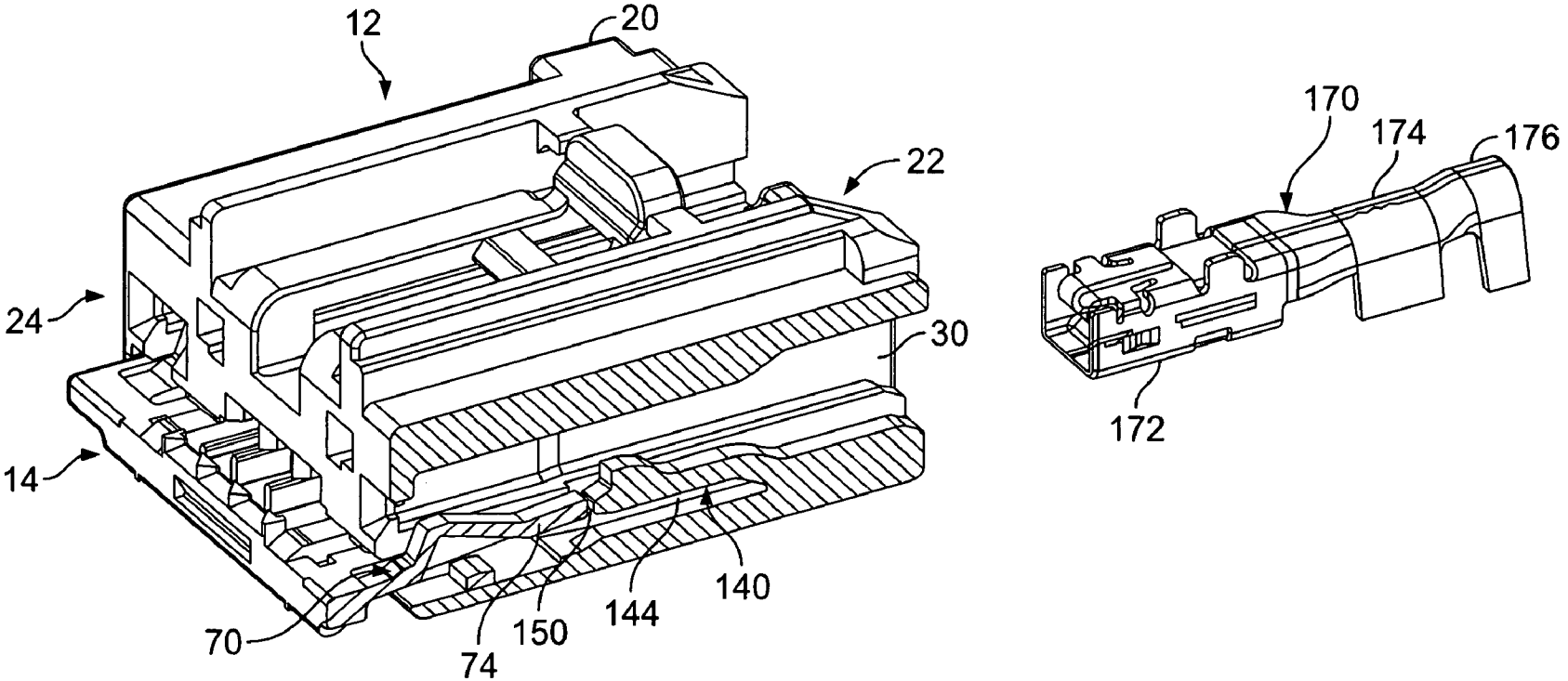
FIG. 8 is a perspective view of the connector and staged TPA of FIG. 7 prior to loading of a power contact.

The operation of the deflectable beams 70 during the loading of a power contact will be described with reference to FIGS. 8 through 11. FIG. 8 illustrates the connector 12 with the TPA member 14 in the staged position prior to loading of the power contact 170. In one embodiment, the power contact 170 includes a contact box 172. A wire crimp area 174 and an insulation crimp area 176 are provided for attaching the power contact 170 to an insulated wire or cable. The power contact 170 is positioned at the terminal receiving end 22 of the housing 20 and is aligned for entry into the contact cavity 30.

In the staged position, the engagement end 74 of the deflectable beam 70 is in abutting engagement with the TPA stop element 150. In this condition, the TPA stop element 150 provides a positive stop that prevents the TPA member 14 from being moved to the final position.

Figure 9:
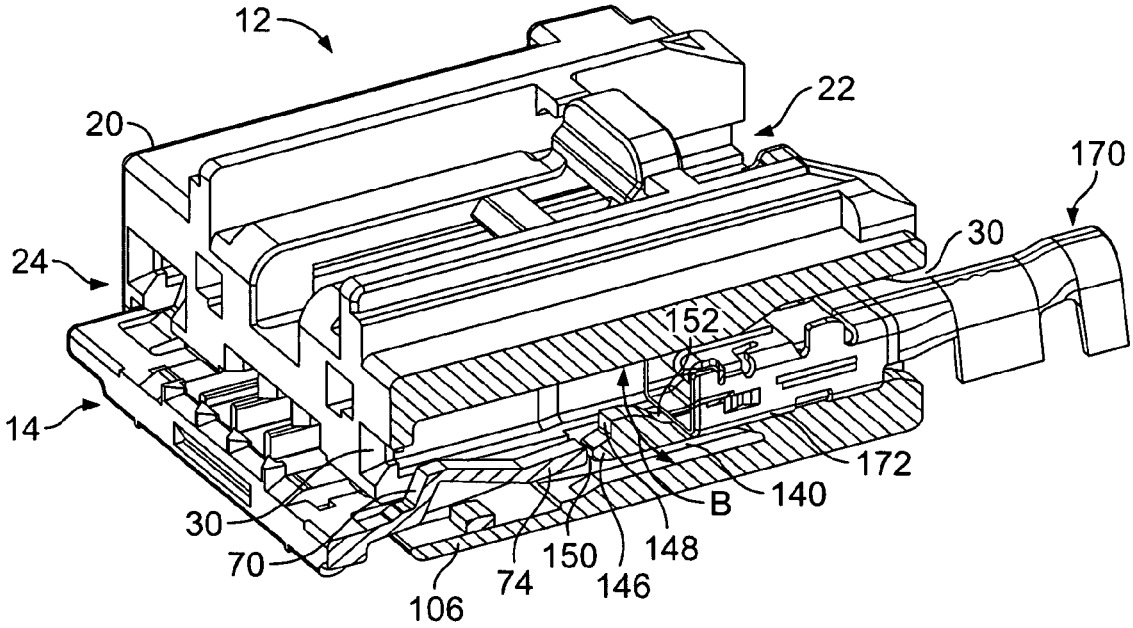
FIG. 9 is a perspective view of the connector and staged TPA of FIG. 7 with a partially loaded power contact.

FIG. 9 is a perspective view of the connector 12 and staged TPA member 14 with the power contact 170 partially loaded. The power contact 170 is inserted into the contact cavity 30 from the terminal receiving end 22 of the housing 20. When the power contact 170 is sufficiently advanced into the contact cavity 30, the power contact 170 engages the ramped section 152 of the second contact retention member 140. Continued advancement of the power contact 170 into the contact cavity 30 causes the second contact retention member 140 to pivot downward toward the housing bottom wall 106, moving the second end 146 into the gap 144 which indicates that the power contact 170 is only partially seated. When the second end 146 of the second contact retention member 140 is deflected into the gap 144, the TPA member is still inhibited from being moved to the final position by either the TPA stop element 150 or the contact latch 148, depending on the amount of deflection of the second contact retention member 140.

Figure 10:
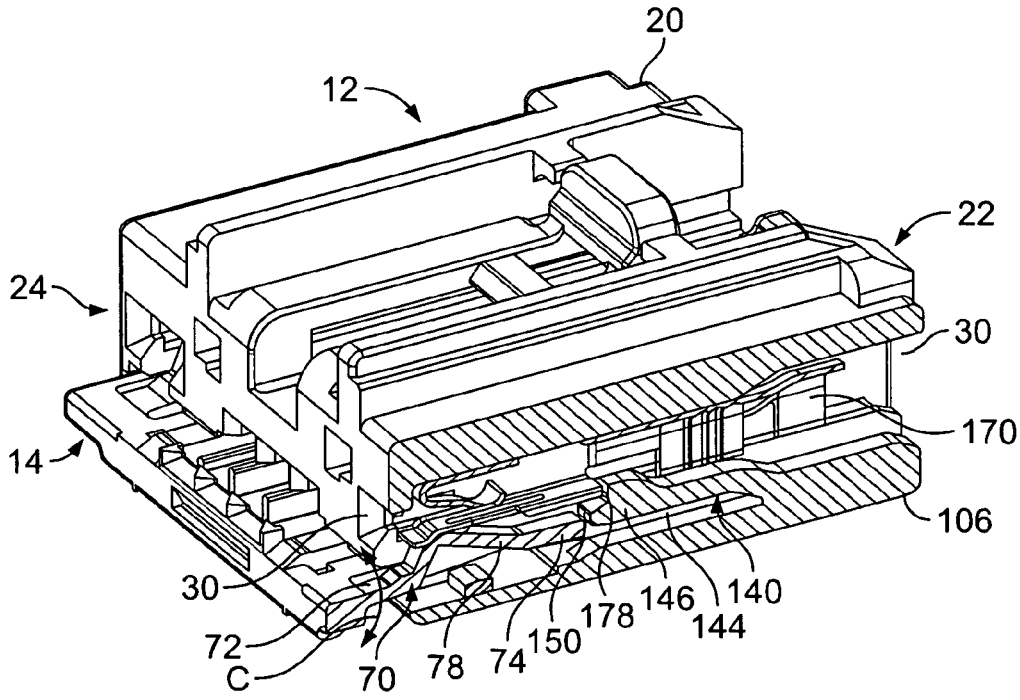
FIG. 10 is a perspective view of the connector and staged TPA of FIG. 7 with a fully loaded power contact.

FIG. 10 is a perspective view of the connector 12 and staged TPA member 14 with the power contact 170 fully loaded into the contact cavity 30. As the power contact 170 is advanced further into the contact cavity 30, the power contact 170 encounters the ramped section 78 of the deflectable beam 70 causing the deflectable beam 70 to pivot about the attachment end 72 and moving the engagement end 74 downward toward the housing bottom wall 106. As the power contact 170 is advanced to a fully loaded or fully seated position, the second end 146 of the second contact retention member 140 returns to its biased position wherein the contact latch 148 engages an edge 178 of the contact box portion 172 of the power contact 170 to retain the power contact 170 in the contact cavity 30. Simultaneously, as the power contact moves to the fully seated position, the deflectable beam 70 of the TPA member 14 is deflected sufficiently so that the engagement end 74 of the deflectable beam 70 is aligned to be received in the gap 144.

Figure 11:
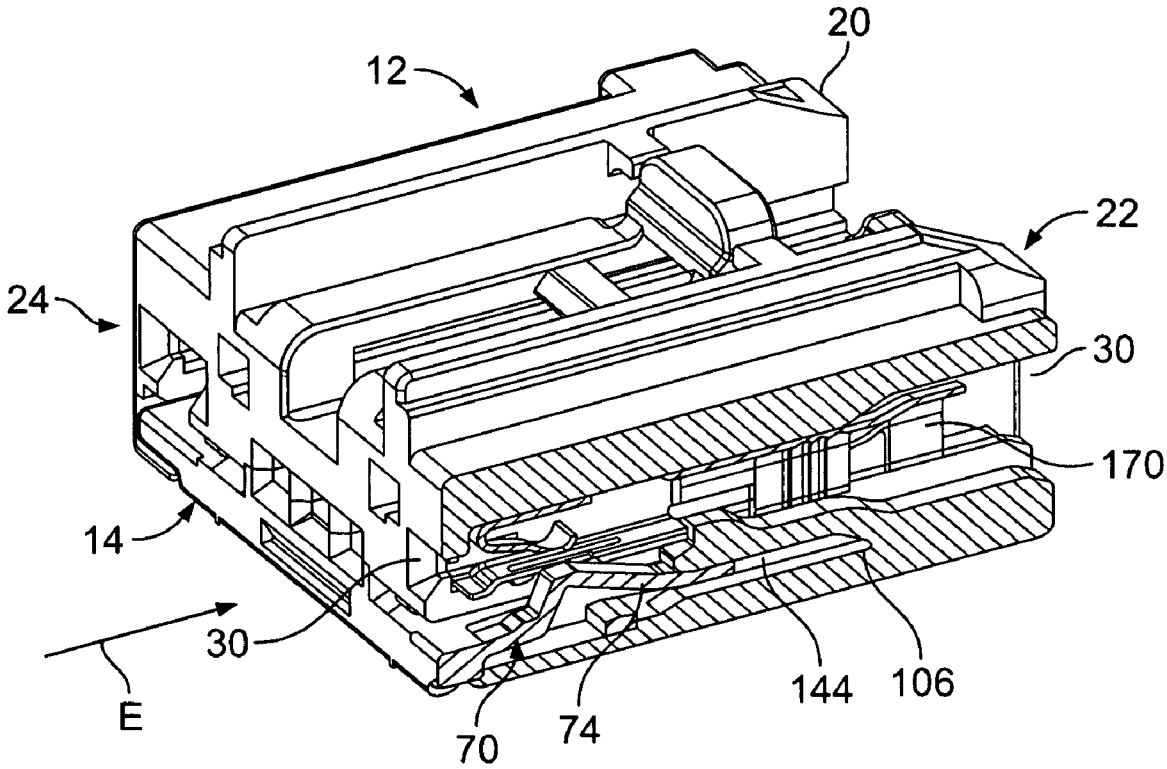
FIG. 11 is a perspective view of the connector and TPA of FIG. 9 with the TPA in the final position.

FIG. 11 is a perspective view of the connector 12 with the TPA member 14 in the final position. When the power contact 170 is fully loaded or seated in the contact cavity 30, the engagement end 74 of the deflectable beam 70 is aligned with the gap 144. The TPA member 14 can then be moved to the final position by advancing the TPA member 14 into the housing 20 in the direction of the arrow E. When the TPA member 14 is moved to the final position, the engagement end 74 of the deflectable beam 70 is received in the gap 144 and blocks downward movement of the second retention element 140 so that the power contact 170 is retained in the housing 20. In order for the TPA member 14 to be moved to the final position, all of the power contact cavities 30 must have a power contact 170 fully loaded in the contact cavity. Usage of the signal contact cavities 32 is optional, however, if a signal contact 120 (FIG. 6) is present, it must also be fully loaded in the signal contact cavity 32 before the TPA member 14 can be moved to the final position.

The embodiments thus described provide a connector 12 with a terminal position assurance (TPA) member 14 that cannot be placed in a final position until contacts 170 are fully loaded in the power contact cavities 30. In this manner, the TPA member 14 cannot inadvertently be placed in the final position. The TPA member 14 includes deflectable beams 70 at the power contact locations 30 that are engaged by the power contacts 170 and deflected to a position that allows the TPA member 14 to be moved to the final position. Fixed wedges 64 are provided at the signal contact cavities 32 in the connector 12 to verify that signal contacts 120, if present, are fully loaded.

While the invention has been described in terms of various specific embodiments, those skilled in the art will recognize that the invention can be practiced with modification within the spirit and scope of the claims.

What is claimed is:

1. An electrical connector comprising:

a housing having a contact cavity configured to receive an electrical contact along a contact loading path, said housing including a stop element; and a terminal position assurance (TPA) member loaded on said housing, said TPA member being moveable between a staged position and a final position, said TPA member having a deflectable beam;

said stop element engaging said deflectable beam in said staged position to prevent advancement of said TPA member from said staged position to said final position, said deflectable beam being positioned, when in said staged position, to extend into the contact cavity and interfere with the contact loading path, as the contact is loaded along the contact loading path, the contact engaging and pivoting said deflectable beam out of the contact cavity away from the contact loading path.

2. The connector of claim 1, wherein said TPA member includes a platform, said platform having said deflectable beam and a latch that engages an interior surface of said housing to inhibit extraction of said TPA member from said housing when said TPA member is in said staged position.

3. The connector of claim 1, wherein said stop element is positioned to interfere with the contact loading path and extend within said contact cavity, as the contact is loaded along the contact loading path, the contact engaging and pivoting said stop element out of the contact cavity away from the contact loading path.

4. The connector of claim 1, wherein said housing includes a wall and said stop element is separated from said wall by a gap, as said contact is being loaded, said contact deflecting said deflectable beam away from said contact loading path to align with and enter said gap.

5. The connector of claim 1, wherein said housing includes a signal contact cavity and a power contact cavity and said deflectable beam is received in said power contact cavity, said TPA member including a non-deflectable fixed wedge received in said signal contact cavity.

6. The connector of claim 1, wherein said deflectable beam includes an engagement end that abuts against said stop element to inhibit said TPA member from moving to said final position when no contact is loaded in said power contact cavity.

7. An electrical connector comprising:

a housing having a contact cavity configured to receive an electrical contact along a contact loading path, said housing including a contact retention element; and a terminal position assurance (TPA) member loaded on said housing and having a deflectable beam, said TPA member being moveable between a staged position and a final position, the deflectable beam and contact retention element both extending into the contact cavity and are aligned such that the contact first engages and pivotally deflects said contact retention element and second engages and pivotally deflects said deflectable beam as the contact is loaded along the contact loading path;

the contact engaging said deflectable beam when the contact is fully loaded in said housing to enable said TPA member to move from said staged position to said final position wherein the contact is retained in said housing.

8. The connector of claim 7, wherein said deflectable beam having an engagement end, an opposite attachment end, and a ramped portion therebetween, wherein said deflectable beam pivots about said attachment end when the contact engages said ramped portion.

9. The connector of claim 7, wherein said deflectable beam and contact retention element are aligned with one another until the contact is fully loaded in said housing.

10. The connector of claim 7, wherein said TPA member includes a platform, said platform having a latch that engages an interior surface of said housing to inhibit extraction of said TPA member from said housing when said TPA member is in said staged position.

11. The connector of claim 7, wherein said housing includes a power contact cavity, and said contact retention element and deflectable beam are positioned within said power contact cavity.

12. The connector of claim 7, wherein said contact retention element engages said deflectable beam to inhibit said TPA member from moving from said staged position to said final position until the contact is fully loaded in said housing.

13. The connector of claim 7, wherein the contact engages said deflectable beam as said contact is being loaded to deflect said deflectable beam away from said contact loading path.

14. The connector of claim 7, wherein said housing includes a signal contact cavity and a power contact cavity, said deflectable beam being received in said power contact cavity and said TPA member includes a fixed wedge received in said signal contact cavity.

15. The connector of claim 7, said housing includes a power contact cavity and said TPA member is inhibited from moving to said final position until a contact is loaded in said power contact cavity.

16. An electrical connector comprising:

a housing having a contact cavity configured to receive an electrical contact along a contact loading path, said housing including a wall and a stop element, said stop element being separated from said wall by a gap; and a terminal position assurance (TPA) member loaded on said housing and having a deflectable beam, said TPA member being moveable between a staged position and a final position, said stop element engaging said deflectable beam in said staged position to prevent advancement of said TPA member to said final position until a contact is fully loaded in said housing, the contact engaging said deflectable beam and pivoting said deflectable beam into aliment with said gap between said stop element and said wall when the contact is fully loaded in said housing to enable said TPA member to move from said staged position to said final position wherein the contact is retained in said housing.

17. The connector of claim 16, wherein the contact engages said deflectable beam as said contact is being loaded to deflect said deflectable beam away from said contact loading path.

18. The connector of claim 16, wherein said housing includes a signal contact cavity and a power contact cavity and said TPA member includes said deflectable beam received in said power contact cavity and a fixed wedge received in said signal contact cavity.

19. The connector of claim 16, wherein said deflectable beam having an engagement end, an opposite attachment end, and a ramped portion therebetween, wherein said deflectable beam pivots about said attachment end when the contact engages said ramped portion.

20. The connector of claim 16, wherein said housing includes a power contact cavity, and said stop element is positioned within said power contact cavity.

* * * * *